US005276495A

United States Patent [19]

Maruta et al.

[11] Patent Number: 5,276,495

[45] Date of Patent: Jan. 4, 1994

[54] COPYING MACHINE CAPABLE OF DISCHARGING PAPER WITHOUT FORMING IMAGE THEREON

[75] Inventors: Syuzi Maruta, Toyokawa; Masazumi Ito, Toyohashi; Tadashi Ohira, Toyokawa, all of Japan

[73] Assignee: Minolta Camera Kabushiki Kaisha, Osaka, Japan

[21] Appl. No.: 512,423

[22] Filed: Apr. 23, 1990

Related U.S. Application Data

[62] Division of Ser. No. 21,210, Mar. 3, 1987, Pat. No. 4,963,946.

[30] Foreign Application Priority Data

Mar. 4, 1986 [JP] Japan ..... 61-46859
Mar. 4, 1986 [JP] Japan ..... 61-46860

[51] Int. Cl.[5] ..... G03G 15/00; G03G 21/00

[52] U.S. Cl. ..... 355/313; 355/319

[58] Field of Search ..... 355/313, 314, 318, 319

[56] References Cited

U.S. PATENT DOCUMENTS 1,090,787 5/1978 Hubbard et al. ..... 355/314
4,067,649 1/1978 Hubbard et al. ..... 355/313
4,110,032 8/1978 Hubbard et al. ..... 355/313 X

*Primary Examiner*—Fred L. Braun
*Attorney, Agent, or Firm*—Burns, Doane, Swecker & Mathis

[57] ABSTRACT

A copying machine capable of correctly counting the number of printed copying papers, more specifically, capable of interrupting the counting task when some copying papers stored in the intermediate storage unit or marking papers for classifying printed copying papers are discharged without forming any image thereon.

10 Claims, 10 Drawing Sheets

COPYING MACHINE CAPABLE OF DISCHARGING PAPER WITHOUT FORMING IMAGE THEREON

This application is a divisional, of U.S. patent application Ser. No. 021,210, filed Mar. 3, 1987, now U.S. Pat. No. 4,963,946

BACKGROUND OF THE INVENTION

1. Field of the Invention

The present invention relates to a copying machine for forming an image or images selectively on one or both sides of a copying paper and, more specifically, to such a copying machine capable of discharging a copying paper and/or marking paper without forming any image thereon.

2. Description of Related Art

Some copying machine rental system charges rental corresponding to the number of sides of copying papers on which images are formed, and the rental is calculated on the basis of a count indicated on a counter. A conventional copying machine for such a copying machine rental system has a marking paper inserting function for inserting a marking paper between successive copying papers discharged after copying to divide the copying papers into groups, and a reserved copying paper discharging function for discharging papers stored temporarily in an intermediate storage unit and each carrying an image on one side thereof. A counter is incorporated in such a copying machine.

To classify printed copying papers, the marking paper inserting function is applied to inserting a marking paper, such as a colored paper, between the printed copying papers, while the reserved copying paper discharging function is applied to discharging copying papers printed only on one side and temporarily stored in the intermediate storage unit without printing on the other side. The counter counts both the printed copying papers and the marking papers indiscriminately. Accordingly, in some cases, the count of the counter is greater than the number of actually printed sides of copying papers, and hence the rental is greater than normal.

The same problem arises in a duplex copying machine in recording the number of printed copying papers by means of a key counter for individual copying tasks. That is, when some copying papers are left in the intermediate storage unit in the preceding copying task and these copying papers are discharged at the beginning of the next copying task, the number of those copying papers stored in the intermediate storage unit in the preceding copying task which is to be included in the number of printed copying papers of the preceding copying task is added to the number of printed copying papers produced in the subsequent copying task.

SUMMARY OF THE INVENTION

Accordingly, an object of the present invention is to provide a copying machine capable of correctly counting the number of printed copying papers.

Another object of the present invention is to provide a copying machine capable of correctly counting the number of printed copying papers for each copying task even when some printed copying papers printed in the preceding copying task are left in the copying machine.

The above and other objects, features and advantages of the present invention will become apparent from the following description when taken in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
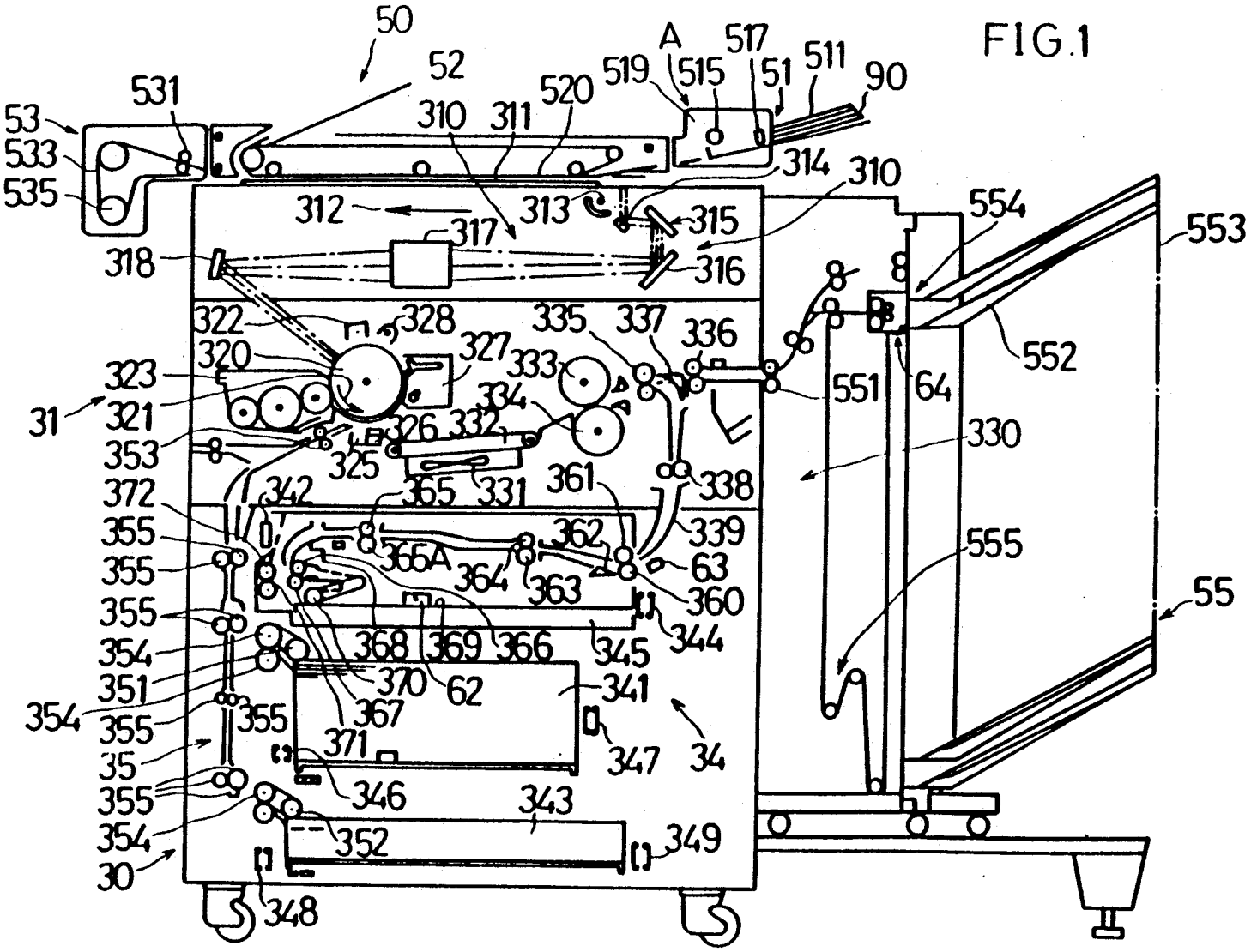
FIG. 1 is a schematic sectional side elevation showing the general construction of a copying machine, in a preferred embodiment, according to the present invention.

Referring to FIG. 1, a copying machine embodying the present invention comprises a copying unit 30, an automatic document feeding and reversing unit (hereinafter abbreviated to "ADFR") 50 for automatically feeding documents 90 one by one onto a contact glass 311 of the copying unit 30 and, when necessary, for reversing the document 90 once fed onto the contact glass 311, and feeding the same again onto the contact glass 311, an a sorting unit 55 for sorting copying papers delivered thereto from the copying unit 30.

The copying unit 30 comprises an image forming and copying mechanism 31, a copying paper storage and supply mechanism 34, and copying paper feeding mechanism 35.

The image forming and copying mechanism 31 comprises an optical system 310 for scanning the surface to be copied of the document 90 placed on the contact glass 311, a photosensitive drum 320 on which an electrostatic latent image is formed by the optical system 310, a developing device 323 for developing the electrostatic latent image formed on the photosensitive drum 320 to produce a toner image, a transfer charger 325 for transferring the toner image onto a copying paper, and a fixing device 330 for fixing the toner image on the copying paper.

The optical system 310 is disposed below the contact glass 311 so as to scan the surface of the document 90 in the direction of an arrow 312. The optical system 310 comprises an exposure lamp 313, movable mirrors 314, 315 and 316, focusing lens 317 and a fixed mirror 318. In scanning the surface of the document, the exposure lamp 313 and the movable mirror 314 travel together in the direction of the arrow 312 at a speed of v/m (v=The circumferential speed of the photosensitive drum fixed irrespective of copying modes, an isometric copying mode and magnification copying mode, m=magnification), while the movable mirrors 315 and 316 travel together in the direction of the arrow 312 at a speed of v/2m. The photosensitive drum 320 is rotated in the direction of an arrow 321, namely, in a counterclockwise direction. An electrification charger 322, the developing device 323 of a magnetic brush type, the transfer charger 325, a separating charger 326, a cleaning device 327 of a blade type, and an eraser lamp 328 are arranged sequentially around the photosensitive drum 320. As the photosensitive drum 320 is rotated counterclockwise, the circumference thereof is electrified uniformly by the electrifying charger 322, then the circumference of the photosensitive drum 320 is exposed to the image by the optical system 310 to form an electrostatic latent image thereon, and then the electrostatic latent image is developed to produce a toner image by the developing device 323. The copying paper carrying the unfixed toner image is conveyed from the developing device 323 to the fixing device 330 by a conveying mechanism including a conveyor belt 332 and a suction device 331 for attracting the copying paper to the conveyor belt 332 by suction. The fixing device 330 comprises, as the principal components, a heating roller 333 for fusing the toner forming the toner image, a fixing roller 334 for fixing the fused toner image on the copying paper. A pair of transfer rollers 335 and a pair of delivery rollers 336 are disposed in that order adjacent to the fixing device 330. A guide plate 337 is disposed between the transfer rollers 335 and the delivery rollers 336 to selectively change the path of the copying paper. The guide plate 337 is set at a position indicated by imaginary lines in FIG. 1 to deliver the copying paper into the box of the sorting unit 55. The guide plate 337 is set at a position indicated by continuous lines in FIG. 1 when the copying paper is required to be subjected to the copying process again for duplex or for composite copying, which will be described hereinafter, to deliver the copying paper through a pair of transfer rollers 338 and a guide plate 339 to an intermediate storage device 345.

The copying paper storage and supply mechanism 34 comprises an upper copying paper supply device 341 of a lifting table type, a lower copying paper supply device 343 of a cassete type, and the intermediate storage device 345. These devices 341, 343 and 345 can be drawn out from the front of the copying unit 30 along guide rails 342 and 344, 346 and 347, and 348 and 349, respectively.

The copying paper feeding mechanism 35 comprises a first main feed roller 351 for feeding the copying papers contained in the upper copying paper supply device 341, a second main feed roller 352 for feeding the copying paper contained in the lower copying paper supply device 343, two pairs of feed rollers 354 disposed after the first main feed roller 351 and the second main feed roller 352 for feeding the copying papers one by one from the upper copying paper supply device 341 and the lower copying paper supply device 343, respectively, transfer rollers 355 sequentially arranged after the feed rollers 354, and a pair of timing rollers 353. The copying paper is transferred along guide plates to the timing rollers 353 by the transfer rollers 355.

The timing rollers 353 are rotated intermittently in synchronism with the photosensitive drum 320 to deliver the copying paper in phase with the toner image formed over the circumference of the photosensitive drum 320 to a transfer section, where the toner image is transferred to the copying paper by the agency of the transfer charger 325. Then the copying paper carrying the toner image is separated from the circumference of the photosensitive drum 320 by the agency of a separating charger 326, and then the copying paper is conveyed by the conveyor belt 332 to the fixing device 330, where the toner image is heat-fixed on the copying paper.

After the toner image has been transferred to the copying paper, the toner remaining over the circumference of the photosensitive drum is removed by the cleaning device 327, and then the circumference of the photosensitive drum 320 is irradiated by the eraser lamp 328 to remove the residual charge, so that the photosensitive drum 320 is ready for the next copying cycle.

The intermediate storage device 345 has a changeover mechanism, a transfer mechanism, a reversing mechanism, a storage mechanism, and a refeeding mechanism. The intermediate storage device 345 is supported at the opposite ends thereof on rails 342 and 344 so as to be drawn out from the front of the copying unit 30 in a direction perpendicular to the copying paper feeding direction to facilitate maintenance work and removal of jammed copying papers.

The changeover mechanism comprises transfer rollers 360 and 361, and a guide plate 362. The changeover mechanism need not necessarily be included in the intermediate storage device; the same may be included in the copying unit 30.

The transfer mechanism comprises transfer rollers 363, 364 and 365, and a guide plate, and is capable of being turned upward on a supporting shaft, not shown, to an open position, when the intermediate storage device is drawn outside the copying unit 30, which facilitates removal of jammed copying papers.

The reversing mechanism comprises reversing rollers 366 and 367, and a reversing guide 368. The reversing mechanism reverses the copying paper transferred thereto from the transfer mechanism, and then delivers the reversed copying paper into an intermediate tray 369.

The storage mechanism comprises the intermediate tray 369, slide rails, sliding members and a regulating plates, which are not shown. The storage mechanism includes an arranging mechanism for arranging the copying papers delivered to the intermediate tray 369 in order.

The refeeding mechanism comprises a holder, a refeed roller 370, separating rollers 371 and 372, and a guide plate. The refeeding mechanism feeds the copying paper stored in the intermediate tray 369 one by one again to the copying unit 30. A sensor 63 is disposed near the guide plate 339 for guiding the copying paper printed on one side to the intermediate storage device 345 to detect the copying sheet being delivered to the intermediate storage device 345. A sensor 62 is disposed in the intermediate storage device 345 to detect the presence of the copying paper in the intermediate tray 369.

Figure 2:
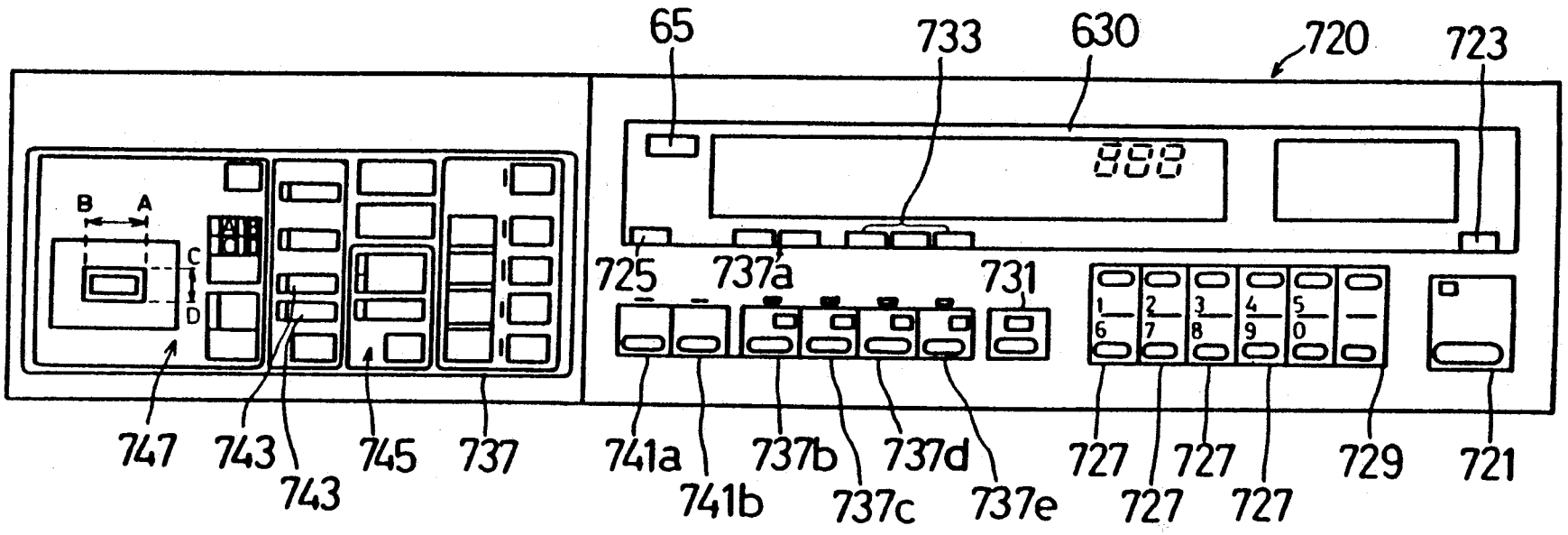
FIG. 2 is a plan view of the control panel of the copying machine of FIG. 1.

When either duplex mode or composite copy mode is selected by operating a selector key of a control panel 720 shown in FIG. 2, the guide plate 337 is set at a position indicated by continuous lines in FIG. 1, so that the copying paper printed on one side thereof is transferred by the transfer rollers 338 through the guide plate 339 to the transfer rollers 360 and 361.

The guide plate 362 can be turned on a shaft, not shown, between two positions, namely, a first position for guiding the copying paper toward the reversing mechanism, and a second position for guiding the copying paper directly into the intermediate tray 369. In the duplex mode, the guide plate is turned to the first position so as to guide the copying paper along the upper surface thereof to the transfer mechanism. Then, the copying paper is transferred leftward, as viewed in FIG. 1, along the guide plate by the transfer rollers 363, 364, 365 and 365A, then the copying paper is reversed by the reversing rollers 366 and 367 along the guide plate 368, and then the copying paper is placed in the intermediate tray 369 with the printed side facing up. The copying papers delivered to the intermediate tray 369 are arranged in order by the arranging mechanism, and are refed one by one by the refeed roller 370.

On the other hand, in the composite copy mode, after passing the transfer rollers 360 and 361, the copying paper is guided along the lower surface of the guide plate 362 directly into the intermediate tray 369, so that the copying paper is placed in the intermediate tray 369 with the printed side facing down. Then, the copying papers are arranged in order by the arranging mechanism, and then the copying papers are refed one by one by the refeed roller 370.

After being subjected to the separating action of the separating rollers 371 and 372, the copying paper is transferred by the transfer rollers 355 to the timing rollers 353, and is fed into the copying unit 30 for duplex copying or composite copying through the normal copying cycle.

The ADFR 50 and the sorting unit 55 will be described briefly hereinafter.

Generally, the ADFR 50 comprises an automatic document feed mechanism 51, a document conveying mechanism 52 and a document reversing mechanism 53.

The automatic document feed mechanism 51 comprises a document feed tray 511 for accommodating documents 90 in a pile, a feed roller 515 for feeding the documents 90 one by one onto the contact glass 311, a driving motor for driving the feed roller 515, and a document detector 517 for detecting the presence of documents on the document feed tray 511.

The document conveying mechanism 52 comprises a conveyor belt 520, and a driving motor for driving the conveyor belt 520.

The document reversing mechanism 53 comprises, as the principal components, drawing rollers 531 for drawing the document 90 from the contact glass 311, a reversing belt 533 for reversing the document 90, and a driving motor 535 for driving the reversing belt 533.

The sorting unit 55 is joined to the right side of the copying unit 30, and comprises, as the principal components, a receiving mechanism 551, a bin assembly 553 having a plurality of vertical bins 552, a delivery mechanism 554 capable of moving vertically along the bin assembly 553, and a conveying mechanism 555 having an endless belts and guide tapes.

The copying paper delivered by the pair of delivery rollers 336 of the copying unit 30 to the receiving mechanism 551 is further delivered through the delivery mechanism 554 by the conveying mechanism 555 to one of the bins 552 of the bin assembly 553. After the delivery of the copying paper has been detected by a copying paper sensor 64 disposed at the entrance of the delivery mechanism 554, the delivery mechanism 554 is shifted to a position opposite the next bin 552 to deliver the next copying paper to the next bin 552. Thus, the copying papers are distributed sequentially to the bins 552. After delivering the copying paper to the lowermost bin 552, the delivery mechanism 554 is returned to a starting position opposite the uppermost bin 552 to wait for the next cycle of copying paper distribution.

The copying paper sensor 64, and the sensor 63 disposed near the intermediate storage device 345 are associated with a counter. The detection of the trailing edge of a copying paper by the sensor 63 or 64 is regarded as the completion of one copying cycle, and the counter adds one to the count. The count obtained by the counter is displayed on the control panel 720 when a total count check button 65 is pressed.

As illustrated in FIG. 2, arranged on the control panel 720 are a print button 721 for starting copying operation, an all-clear key 723 for selecting a standard operating mode, a passage key 725 for instructing the through passage of a copying paper or papers without forming any image thereon, the total count check button 65 for instructing the display of the count obtained by the counter, numeric keys 727, a clear/stop button 729, a copying paper selection button 731, exposure system selection buttons 733, an optional magnification setting key **737*a*, fixed magnification selecting keys 737*b* to 737*e*, a single-side document duplex copy mode selecting button 741*a*, a double-side document duplex copy mode selecting button 741*b*, and a fluorescent display tube 630** for displaying conditions selected or set by means of the keys, such as the size of the copying paper, the number of copies to be produced and magnification.

The copying machine is capable of operating in a through passage mode in which the copying papers stored in the upper copying paper feeding device 341, the lower copying paper feeding device 343 and the intermediate tray 369 are discharged without forming any image thereon. The through passage mode is selected by pressing the through passage key 725 of the control panel 720. In the through passage mode, when copying papers are stored in the intermediate tray 369, the copying papers stored in the intermediate tray 369 are discharged, and, when any copying paper is not stored in the intermediate tray 369, the copying papers stored in the upper copying paper feeding device 341 or those stored in the lower copying paper feeding device 343 are discharged.

Accordingly, when an odd number of single-side documents are copied on the respective both sides of copying papers, the last copying paper remaining in the intermediate tray 369 can be easily discharged in the through passage mode. Furthermore, the copying papers stored in the upper copying paper feeding device 341 or in the lower copying paper feeding device 343 can be inserted between the printed copying papers as marking papers by feeding one copying paper and passing the same through the copying unit 30 without forming any image thereon at a time every predetermined number of copying cycles. In the through passage mode, although the passage of the copying paper is detected by the copying paper sensor 64, the counter does not count the copying paper.

Furthermore, in resetting the copying conditions to predetermined copying conditions, for example, quantity of copies = 1, magnification = 1, the copying machine is set automatically in the through passage mode and, naturally, the counter does not count up. The copying machine is reset when the power switch is turned on, a predetermined time after the end of copying operation or when the all-clear key 723 is pressed.

Figure 3:
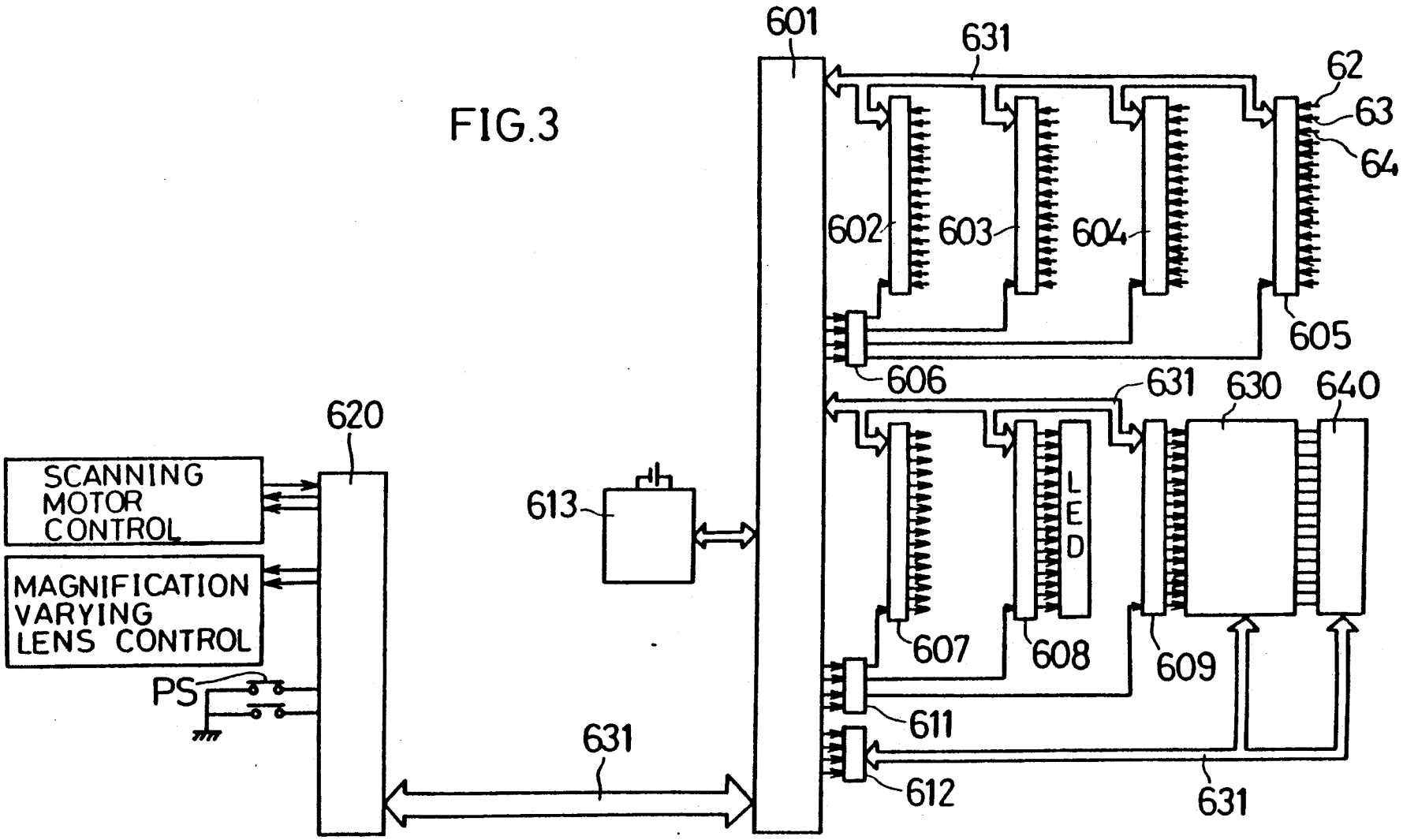
FIG. 3 is a block diagram showing the electric circuit of the control unit of the copying machine of FIG. 1.

FIG. 3 shows a control circuit for controlling the operation of a copying machine. The control circuit comprises, as the principal components, a main CPU 601 (a first microcomputer), an auxiliary CPU 620 (a second microcomputer) connected by bus lines 631 including an address bus line, a data bus line and a control bus line to the main CPU 601, and devices which are driven by control signals given thereto from the main CPU 601 and the auxiliary CPU 620. The devices are substantially the same in function as the corresponding known devices, and hence the description thereof will be omitted. For example, ICs 602 to 605 are extention ICs connected to the main CPU 601 by the data bus line, and are controlled through a decoder 606 by the main CPU 601. The sensors and the control keys are connected to the input terminals of the ICs 602 to 605. The ICs 607 to 609 are output extention ICs, and the control ports thereof are connected through a decoder 611 to the main CPU 601. For example, the display tube 630 and an LED matrix (display LEDs) are connected to the output terminals of the IC 609 to be controlled through the decoder 612 by the main CPU 601. A RAM 613 connected to the main CPU 601 is backed up by a battery. The sensor 62 for detecting the presence of a copying paper or papers in the intermediate tray 369, the sensor 63 for detecting the delivery of a copying paper to the intermediate tray 369, and a sensor 64 for detecting the discharge of a copying paper are connected to the IC 605. The RAM 613 has an electronic counter, namely, the counter.

Control procedures of the control circuit will be described hereinafter with reference to FIGS. 4 to 12.

Figure 4:
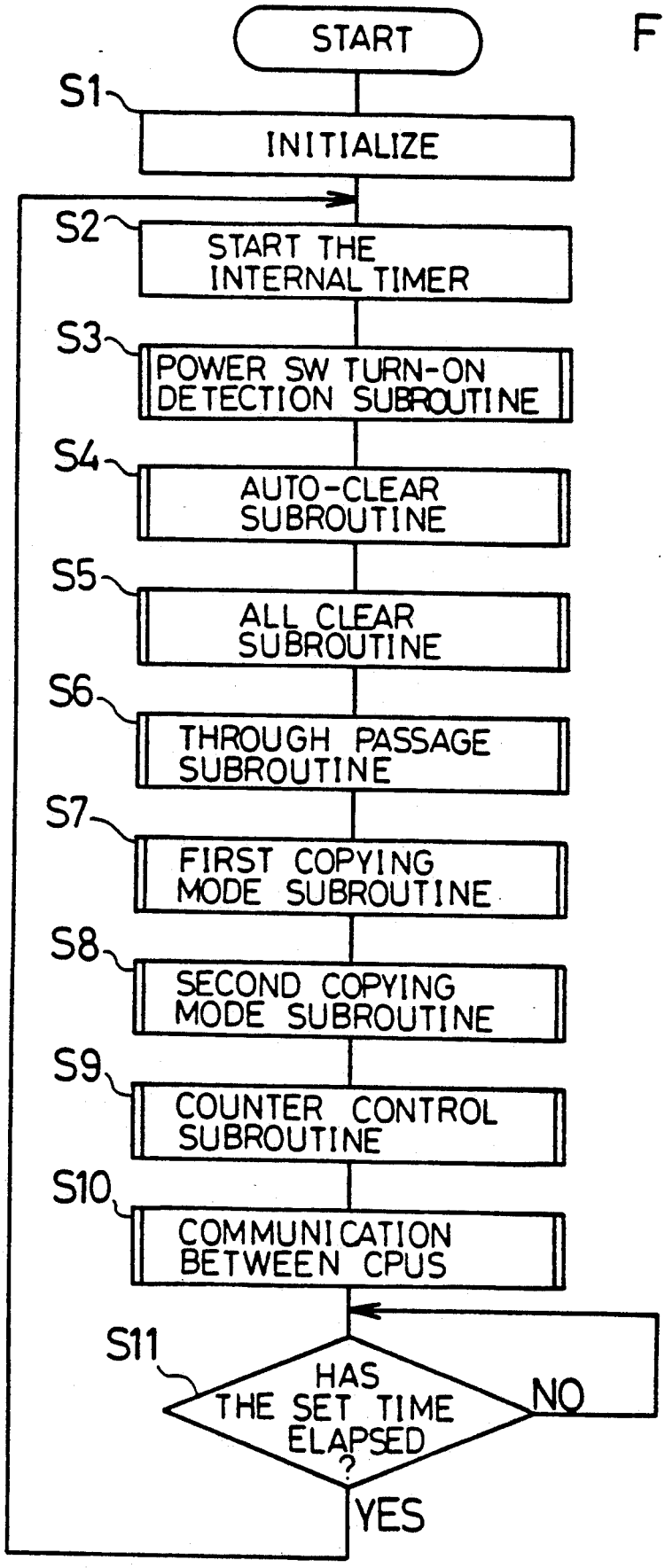
FIG. 4 is a flow chart showing the control procedure of the control unit of FIG. 3.
Figure 5:
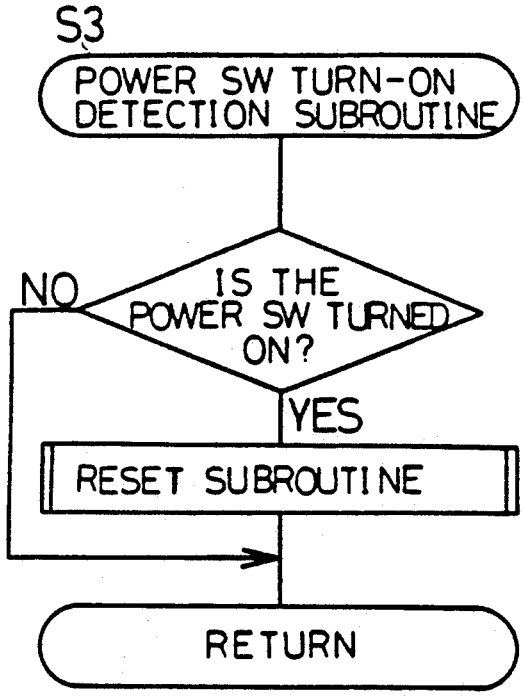
FIG. 5 is a flow chart of a power switch detecting subroutine.

FIG. 4 is a flow chart of a main routine to be executed by the main CPU 601, including the following steps:

Step S1: The RAM and registars are initialized upon the supply of power to the main CPU 601.

Step S2: The internal timer is actuated to fix the time of one cycle of the routine (steps S2 to S11).

Step S3: A power switch turn-on detection subroutine (FIG. 5) to be actuated when the power switch PS is turned on.

Figure 6:
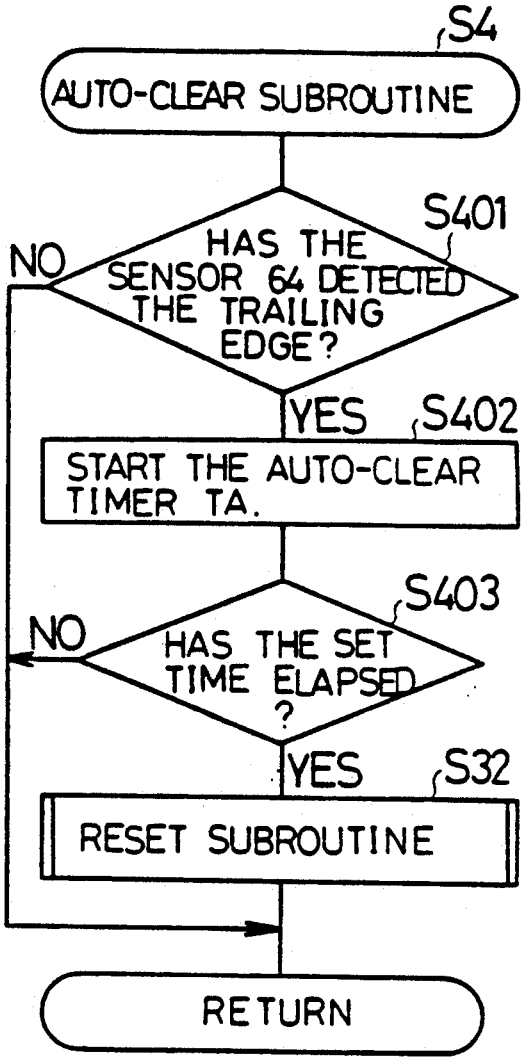
FIG. 6 is a flow chart of an auto-clear subroutine.
Figure 7:
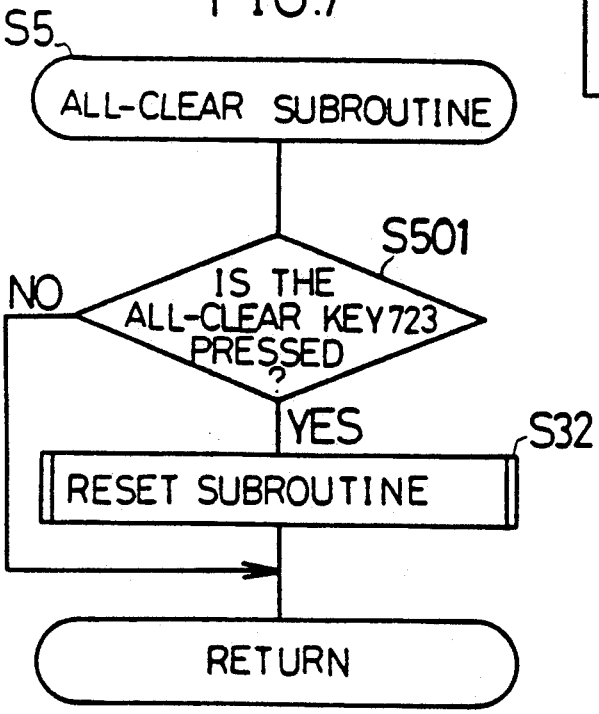
FIG. 7 is a flow chart of an all-clear subroutine.
Figure 8:
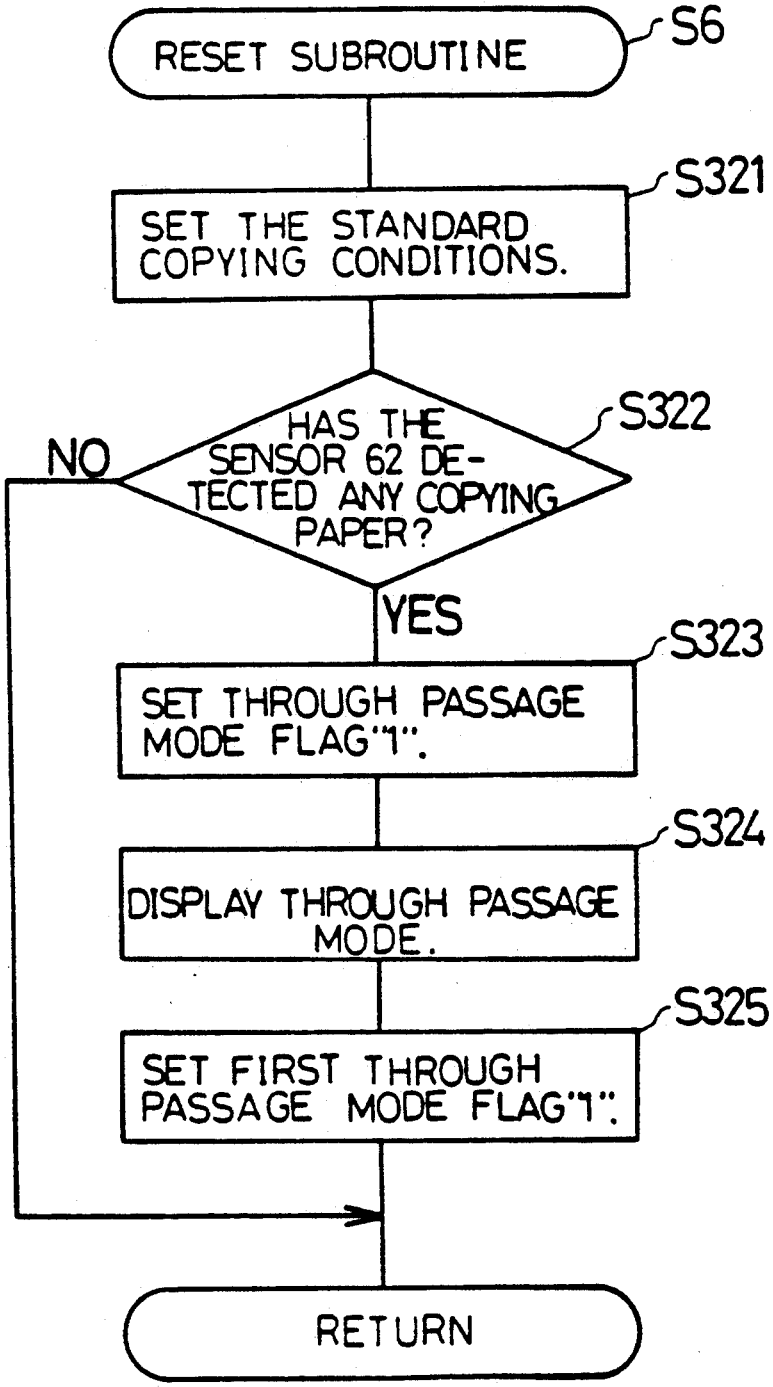
FIG. 8 is a flow chart of a reset subroutine.
Figure 9:
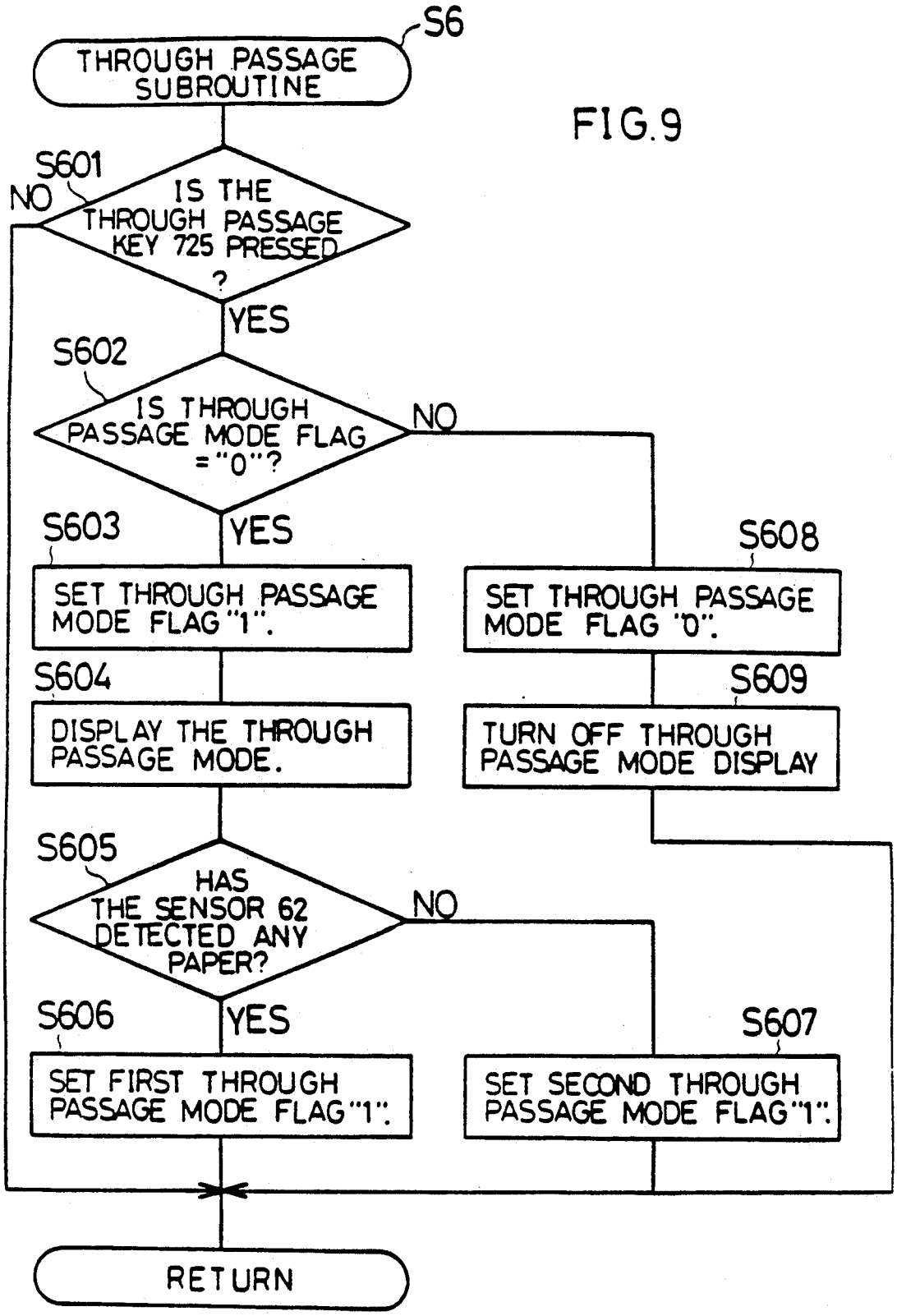
FIG. 9 is a flow chart of a through passage control subroutine.
Figure 10:
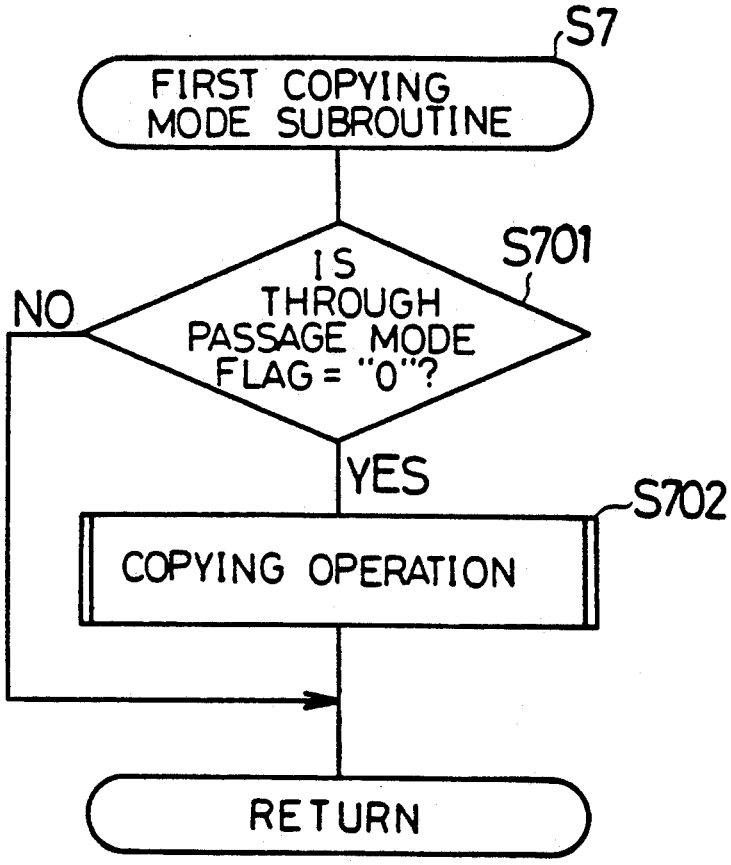
FIG. 10 is a flow chart of a first copying operation control subroutine.
Figure 11:
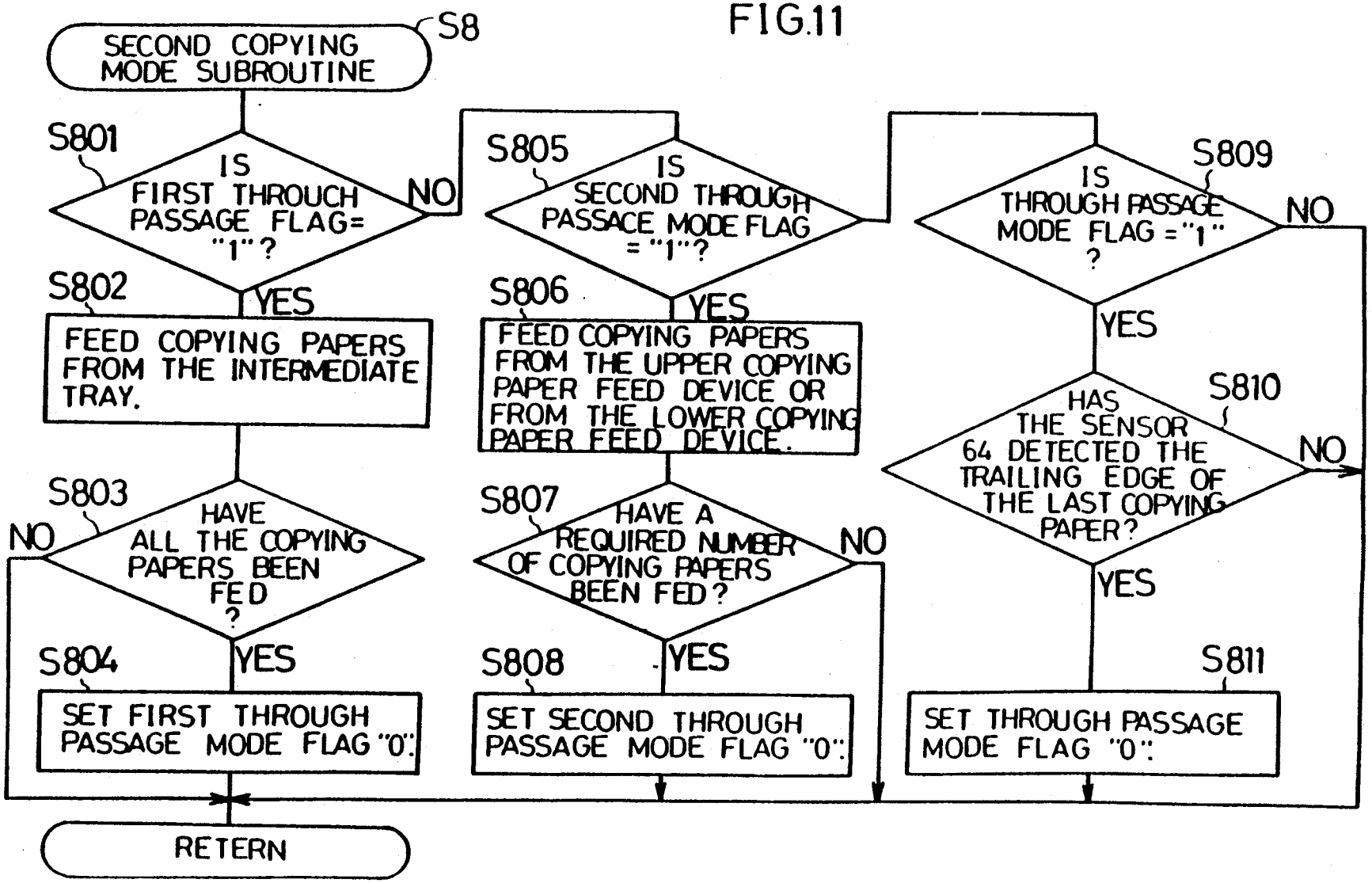
FIG. 11 is a flow chart of a second copying operation control subroutine.
Figure 12:
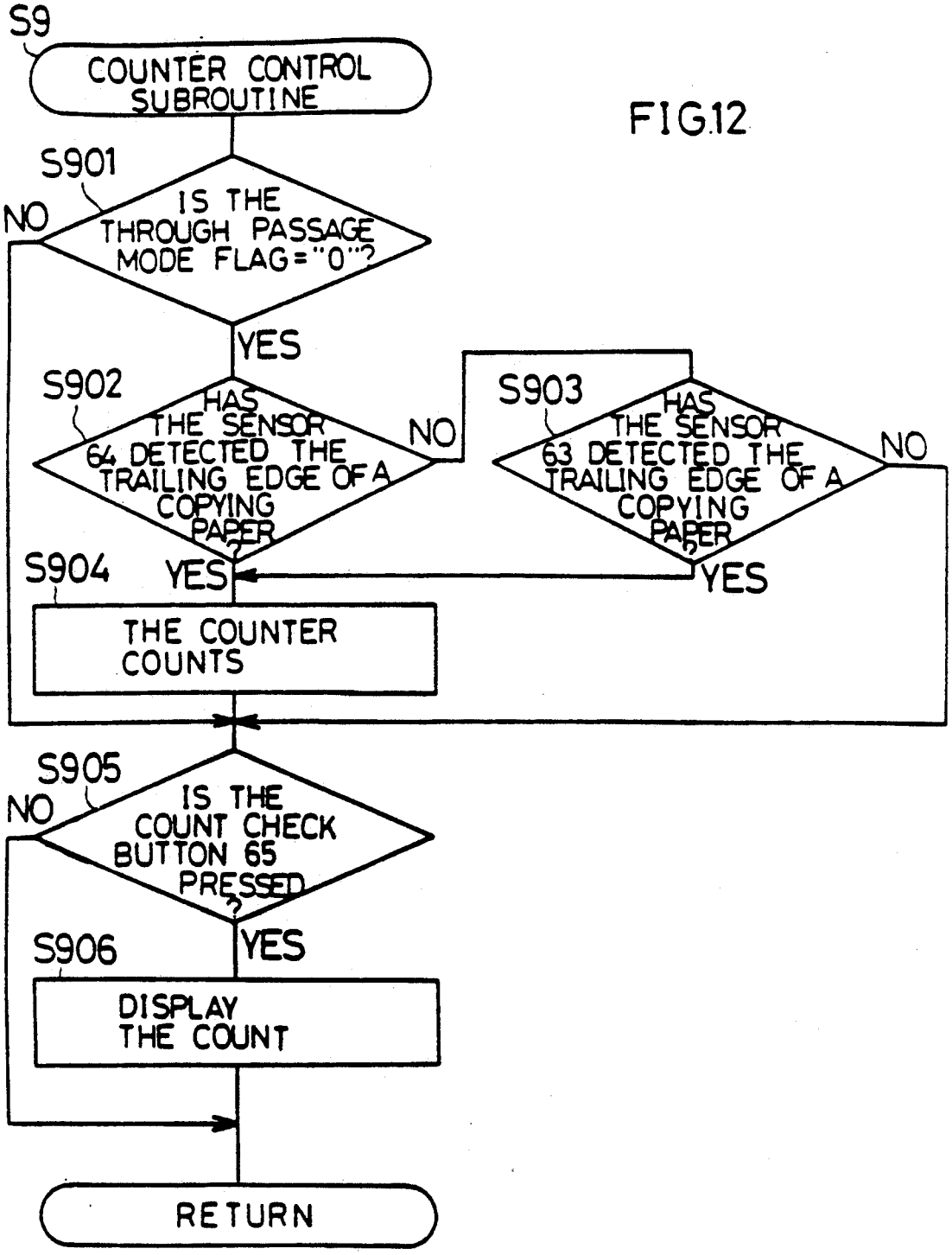
FIG. 12 is a flow chart of a counter control subroutine.

Step S4: An auto-clear subroutine (FIG. 6).

Step S5: An all-clear subroutine (FIG. 7) to be executed when the all-clear key 723 is pressed.

Step S6: A through passage subroutine (FIG. 9) to be executed when the through passage key 725 is pressed.

Step S7: A first copying mode subroutine for normal copying operation under copying conditions set by means of the keys of the control panel 720. The description of this subroutine will be omitted.

Step S8: A second copying mode subroutine (FIG. 9) for discharging a copying paper without forming any image thereon.

Step S9: A counter control subroutine (FIG. 12) for controlling the operation of the counter for counting the number of copying cycles.

Step S10: A communication subroutine for communications between the CPUs. The description of this subroutine will be omitted.

Step S11: A decision as to whether or not the time set by the internal timer at step S2 has elapsed. The routine returns to step S2 when the decision at step S11 is YES.

In the power switch turn-on detection subroutine (FIG. 5), when the decision at step S31 is YES, namely, when the power switch PS is turned on, a reset subroutine (step S32) (FIG. 8) is executed.

In the auto-clear subroutine (FIG. 6), when the trailing edge of a copying paper being discharged is detected by the sensor 64 at step S401, an auto-clear timer Ta is actuated at step S402. Upon the detection of the elapse of the time set by the auto-clear timer Ta at step S403, the reset subroutine is executed. The auto-clear timer Ta may be actuated upon the detection of the trailing edge of a copying paper being delivered to the intermediate storage device 345 by the sensor 63.

In the all-clear subroutine (FIG. 7), the reset subroutine (S32) is executed when a decision that the all-clear key 723 is pressed is made at step S501.

In the reset subroutine (FIG. 8), the copying conditions are reset to the predetermined copying conditions, such as quantity of copies=1, magnification=1, and copying paper feed device=upper copying paper feed device, at step S321. At step S322, a decision is made as to whether or not any copying paper is present in the intermediate tray 369. When the decision at step S 322 is YES, a through passage flag indicating the selection of the through passage mode in which a copying paper is discharged without forming any image thereon is set at step S323, then the through passage mode is displayed on the display tube 630 at step S324, and then a first through passage mode flag indicating the discharge of the copying paper stored in the intermediate tray 369 is set at step S325.

In the through passage control subroutine (FIG. 9), when the through passage key 725 is pressed while the through passage mode flag is "0" at step S602, a through passage mode flag "1" is set at step S603, then the through passage mode is displayed at step S604 and, when any copying paper is present in the intermediate tray 369, a first through passage flag indicating discharging the copying paper from the intermediate tray 369 is set at step S606. When any copying paper is not present in the intermediate tray 369, a second through passage flag indicating discharging a copying paper from the upper copying paper feed device 341 or the lower copying paper feed device 343 is set at step S607, in which either the upper copying paper feed device 341 or the lower copying paper feed device 343 is selected by means of the feed device selection key 731.

On the other hand, when the through passage key 725 is pressed in the through passage mode, the through passage mode flag is changed for "0" at step S608 and the display of the through passage mode is cancelled at step S609.

In the first copying mode subroutine (FIG. 10), when a decision that the through passage mode flag is "0" is made at step S701, the normal copying operation is carried out at step S702. Since the mode of the normal copying operation is a well-known mode, the description thereof will be omitted.

In the second copying mode subroutine (FIG. 11), when the first through passage flag is set, the discharge of the copying papers stored in the intermediate tray 369 is started at step S802. Upon a decision, at step S803, that all the copying papers stored in the intermediate tray 369 have been discharged, the first through passage flag is reset at step S804. When the second through passage flag is set, the upper copying paper feed device 341 or the lower copying paper feed device 343 starts feeding a copying paper or papers at step S806. When a decision that a predetermined number of copying papers have been fed is made at step S807, the second through passage flag is reset at step S808. The through passage mode flag is reset at step S811 upon the detection of the trailing edge of the last copying paper by the sensor 64. During the operation of step S802 or S806, the image forming operation is interrupted. That is, for example, the transfer charger 325 is turned off.

In the counter control subroutine (FIG. 12), when a decision that the through passage mode flag is "0" is made at step S901, the counter counts up at step S904 every detection of the trailing edge of the copying paper being discharged at step S902 or every detection of the trailing edge of the copying paper being delivered to the intermediate tray 369 at step S903. On the other hand, when the through passage mode flag is "1", the counter does not count up. At step S905, a decision is made as to whether or not the count check button 65 is pressed. When the decision at step S905 is YES, the count counted by the counter is displayed on the display tube 630 at step S906.

In this embodiment, if any copying paper is present in the intermediate tray 369 when the power switch is turned on, the all-clear key is pressed or the through passage mode key is pressed, the copying paper or papers stored in the intermediate tray 369 is discharged immediately. However, in such a case, it is also possible to notify the operator of the presence of a copying paper or papers in the intermediate tray 369 and to execute a discharge operation for discharging the copying paper or papers from the intermediate tray 369 in response to a copying paper discharge instruction given, for example, by turning on the print key.

Furthermore, it is possible to provide, instead of the counter employed in this embodiment, a first counter which counts copying papers only in the normal copying mode and does not count copying papers in the through passage mode, and a second counter which counts copying papers only in the through passage mode, to obtain the number of actual copying cycles on the basis of the counts obtained by the first and second counters.

Still further, in addition to the counter incorporated into the copying unit, a key counter which is detachably attached to the copying machine, enables copying operation when attached to the copying machine at a predetermined position, and counts the copying cycles, i.e., the number of printed copying papers may be provided. The manner of operation of the key counter is the same as that of the counter of the foregoing embodiment. Since the constitution of such a key counter is disclosed in U.S. Pat. No. 4,633,405, the description thereof will be omitted. Naturally, the key counter may be a magnetic card, an IC card or such.

Furthermore, in subjecting a first copying paper to the copying operation in the duplex copying mode, it is possible to press the through passage key 725 to deliver the copying paper from the upper copying paper feed device 341 or the lower copying paper feed device 343 to the intermediate tray 369 without forming any image thereon, and to stop the counting operation of the counter.

Having now fully described the invention, it will be apparent to one of ordinary skill in the art that many changes and modifications can be made thereto without departing from the spirit or scope of the invention as set forth herein.

What is claimed is:

1. A copying machine for selectively copying in either a simplex mode or a duplex mode comprising:

means for forming an image on a copying paper;

first copying paper feed means for containing copying paper to be subjected to the copying operation and for feeding the copying papers one by one to said image forming means;

second copying paper feed means for temporarily storing printed copying papers and for feeding the same copying papers one by one again to said image forming means;

a power switch;

means for producing a reset signal to set predetermined standard copying conditions when said power switch is turned on;

means for detecting the presence of a copying paper or papers in said second copying paper feed means; and means for automatically discharging the copying papers stored in said second copying paper feed means outside the copying machine while the operation of said image forming means is interrupted, if any copying paper is detected by said detecting means when said reset signal is produced, regardless of whether the simplex mode or the duplex mode has been selected.

2. A copying machine as recited in claim 1, further comprising:

means for counting the copying papers passing said image forming means; and means for inhibiting the counting operation of said counting means when said copying paper discharge means is activated.

3. The copying machine of claim 1, further comprising a control panel having a plurality of means for setting a plurality of copying conditions; and said reset signal sets all of said plurality of copying conditions to predetermined standard copying conditions.

4. The copying machine of claim 3, wherein said copying conditions include the number of copies to be produced and the size of the copying paper.

5. The copying machine of claim 4, wherein the copying conditions further include magnification.

6. A copying machine, comprising:

means for forming an image on a copying paper;

first copying paper feed means for containing copying papers to be subjected to a copying operation and for feeding the copying papers one by one to said image forming means;

second copying paper feed means for temporarily storing printed copying papers and for feeding the same copying papers one by one again to said image forming means;

means for producing a reset signal to set predetermined standard copying conditions, said means has a timer which is actuated upon the completion of the copying operation and produces a reset signal upon the elapse of the time set by said timer;

means for detecting the presence of a copying paper or papers in said second copying paper feed means; and means for automatically discharging the copying papers stored in said second copying paper feed means outside the copying machine while the operation of said image forming means is interrupted, if any copying paper is detected by said detecting means when the reset signal is produced;

wherein the copying machine can be selectively operated in either a simplex mode or a duplex mode, and said automatic discharge means discharges the copying papers regardless of whether the simplex mode or the duplex mode has been selected.

7. A copying machine as recited in claim 6, further comprising:

means for counting the copying papers passing said image forming means; and means for inhibiting the counting operation of said counting means when said copying paper discharge means is activated.

8. The copying machine of claim 6, further comprising a control panel having a plurality of means for setting a plurality of copying conditions; and said reset signal sets all of said plurality of copying conditions of predetermined standard copying conditions.

9. The copying machine of claim 8, wherein said copying conditions include the number of copies to be produced and the size of the copying paper.

10. The copying machine of claim 9, wherein the copying conditions further include magnification.

* * * * *